United States Patent [19]

Hasenclever

[11] 4,135,879

[45] Jan. 23, 1979

[54] PROCESSES FOR THE TREATMENT OF TEXTILES AND FINISHING AGENTS FOR USE THEREIN

[75] Inventor: Kaspar D. Hasenclever, Taunusstein, Fed. Rep. of Germany

[73] Assignee: Chemische Fabrik Kreussler & Co., GmbH, Wiesbaden-Biebrich, Fed. Rep. of Germany

[21] Appl. No.: 751,601

[22] Filed: Dec. 17, 1976

Related U.S. Application Data

[63] Continuation-in-part of Ser. No. 558,547, Mar. 14, 1975.

[30] Foreign Application Priority Data

Mar. 17, 1974 [DE] Fed. Rep. of Germany ..... 2412175

[51] Int. Cl.[2] ..... D06M 13/32

[52] U.S. Cl. ..... 8/142; 8/115.6; 252/8.6; 252/8.9; 428/265; 428/267

[58] Field of Search ..... 8/115.6, 142; 252/8.6, 252/8.9; 428/265, 267

[56] References Cited

U.S. PATENT DOCUMENTS

| | | | |
|---|---|---|---|
| 2,913,407 | 11/1959 | Schiermeier | 252/8.6 |
| 3,352,790 | 11/1967 | Sugarman | 252/171 |
| 3,432,898 | 3/1969 | Stanley | 252/8.6 |
| 3,671,441 | 6/1972 | Dasch | 8/142 |

*Primary Examiner*—Paul R. Michl
*Attorney, Agent, or Firm*—Michael J. Striker

[57] ABSTRACT

Processes for the treatment of textile fabrics which comprises applying to the fabrics a finishing agent of the group consisting of (a) phosphoric acid esters of poly(oxyethylene) alkanols and salts thereof having the formulae $$[R-O-(CH_2CH_2O)_n]_3P=O$$

or

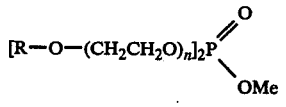

or mixtures of these compounds, in which formulae R is a straight-chain alkyl radical having at least 16 and at most 18 carbon atoms, n is an integer of at least 10 and at most 14, and Me is a monovalent metal ion, and (b) monoglycerides and diglycerides of saturated aliphatic straight-chain fatty acids having at least 12 and at most 14 carbon atoms, and (c) mixtures of the said finishing agents at (a), (b) and (c).

7 Claims, No Drawings

PROCESSES FOR THE TREATMENT OF TEXTILES AND FINISHING AGENTS FOR USE THEREIN

RELATED APPLICATIONS

This application is a continuation in part of application Ser. No. 558,547 filed Mar. 14, 1975.

BACKGROUND OF THE INVENTION

The present invention pertains to the treatment of textiles and fabrics and finishing agents for use therein, either in the finishing of the original textile or in after-treatments of the textile during dry cleaning and similar operations.

The terms finishing agents and finishing treatments that are referred to herein are to be understood to pertain to treatments and agents which improve the hand and fullness of textiles or fabrics — fullness in this sense referring to the bulk or thickness of the fabric — as well as improved wrinkle recovery and permanence of both the pressed creases and the smoothness of the fabric, thereby also affecting its flexibility and stiffness. Dependent upon the kind of treating agent, each of these characteristics is thereby affected to a smaller or greater degree by the finishing agents and processes that are disclosed in this application.

Textiles or fabrics for clothing are now normally treated when made with finishing agents in order to improve the hand and wrinkle recovery of the garment made therefrom. Dependent upon the quality of the fabric, portions of the finishing agent with which the garment has been treated are lost to a greater or lesser degree, thereby affecting the serviceability or durability of the garment. During dry cleaning of clothing, solvent-soluble textile finishing agents, and if the cleaning is effected upon addition of water, also water-soluble finishing are completely or partially removed from such garments. As a result of such dry-cleaning treatments, the hand and fullness of the garment are impaired and its wrinkle recovery and permanence of the finishing effect are decreased. In order to prevent such deterioration of the fabric as a result of dry cleaning, the textile must be retreated after the dry-cleaning operation with a finishing agent. As a result of such after-treatment of the garment, the subsequent pressing operation is simplified or an increase in the efficiency of the steam-pressing apparatus is achieved, and the garment is rendered less sensitive to damage by mechanical handling during transport.

Solutions of natural or synthetic resins, combinations of such resins, mixtures of such resins and waxes or long-chain aliphatic hydrocarbons in organic solvents were heretofore used as finishing agents for this purpose. Normally these finishing agents were applied to the textile after the dry-cleaning operation in a dip and rotate process or in the form of a spray. As an expedient, the finishing agent has recently been frequently added to the dry-cleaning bath. This was possible because almost all of the presently suitable finishing agents that were used for this purpose were filterable.

However, two limitations of this procedure could heretofore not be overcome or obviated. These limitations are as follows:

1. The colloidal chemistry of the ingredients of the finishing agent causes them to behave like soil and to use up surfactant molecules. The detergent action of the dry-cleaning bath is thus reduced and the appearance of graying is promoted.

2. Since the detergent action of organic solids is substantially increased by the addition of water thereto, the emulsifying behavior of detergents in the bath and their water-solubilizing power for the water dispersed therein is of decisive significance. On account of the hydrophobic nature of the finishing agents, the dispersion of the water in the bath is affected.

Detergents are usually adjusted to bring about, in pure dry-cleaning solvents, optimal conditions for the solubilization and emulsification of the water. Since these properties of detergents are affected by the presence of the finishing agents in the dry-cleaning bath, shrinkage and felting of the garments and textiles that are cleaned may occur, as described by Hasenclever and Naumann under the title "Chemischreinigung" in Technical Section T76 of the "Handbücher für Textilingenieure und Textilpraktiker," published by Dr. Spohr-Verlag, Stuttgart, German Federal Republic.

SUMMARY OF THE INVENTION

It has now been found that specific esters and alkali-metal salts of esters of phosphoric acid and condensation products of ethylene oxide and saturated fatty alcohols having long straight chains, as well as monoglycerides and diglycerides of saturated aliphatic straight-chain carboxylic acids have a distinct effect in improving the hand and increasing the wrinkle recovery of textiles and fabrics without having an undesirable emulsifying effect upon the water in dry-cleaning baths. The condensation products of ethylene oxide with fatty alcohols are referred to hereinafter as poly(oxyethylene) alkanols, as exemplified by poly(oxyethylene)hexadecanol.

More specifically, phosphoric acid esters conform to the following general formulae:

$$[R{-}O{-}(CH_2CH_2O)_n]_3P{=}O \qquad \text{(Ia)}$$

or $$[R{-}O{-}(CH_2CH_2O)_n]_2P(=O)(OMe) \qquad \text{(Ib)}$$

in which R represents a straight-chain alkyl radical having at least 16 and at most 18 carbon atoms, $n$ is an integer of at least 10 and at most 14, and Me is an ion of a monovalent metal such as an alkali-metal. These esters are produced by esterification of the poly(oxyethylene) alkanol with phosphoric acid and are obtained as mixtures of varying amounts of tri- and diesters. It is of course possible to separate the diesters and triesters from each other and to use them as such but this would have no advantage over the use of the mixture of both.

The mixture of phosphoric acid esters and sodium salts thereof that are used in the Examples which follow, which are referred to hereinafter simply as Phosphate Esters 1 and 2, were prepared by the following procedures:

Phosphate Ester 1: Mixture of tri-[poly(oxyethylene) stearyl]monophosphate and sodium di-[poly(oxyethylene)stearyl]monophosphate.

This mixture was prepared by condensing 50 mols of ethylene oxide with 5 mols of stearly alcohol (n-octadecanol) and esterifying the resulting poly(oxyethylene)stearyl alcohol condensation product with 2 mols of orthophosphoric acid and neutralizing the resulting mixture with sodium hydroxide. The phosphate ester and salt thereof that are present in the mixture are represented by the following formulae:

$$[CH_3(CH_2)_{17}—O—(CH_2CH_2O)_{10}]_3P=O$$

and

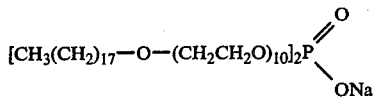

The poly(oxyethylene)stearyl alcohol before esterification, which have essentially the same waxlike appearance and consistency as the phosphate ester, was used as such in Example 4 hereinafter.

Phosphate Ester 2: Mixture of tri-[poly(oxyethylene)-palmityl]monophosphate, tri-[poly(oxyethylene)-stearyl]-monophosphate, and sodium di-[poly(oxyethylene)palmityl]-monophosphate and sodium di-[poly(oxyethylene)stearyl]monophosphate.

This mixture was prepared by condensing 70 mols of ethylene oxide with 5 mols of a mixture of palmityl and stearyl alcohols (n-hexadecanol and n-octadecanol) and esterifying the resulting poly(oxyethylene) alcohol condensation products with 2 mols of orthophosphoric acid and neutralizing the resulting mixture with sodium hydroxide.

The phosphate esters and salts thereof that are present in the mixture are represented by the following formulae:

$$[CH_3(CH_2)_{15}—O—(CH_2CH_2O)_{14}]_3P=O$$

$$[CH_3(CH_2)_{17}—O—(CH_2CH_2O)_{14}]_3P=O$$

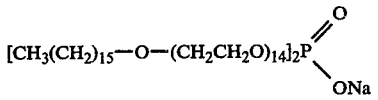

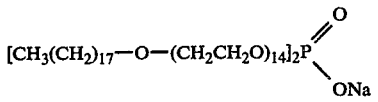

The monoglycerides and diglycerides of fatty acids that are referred to herein, which have the empirical formulae $$R_2—C_3H_7O_3 \quad (II)$$

and $$(R_2)_2C_3H_6O_3 \quad (III)$$

cannot be represented satisfactorily by structural formulae since they consist of mixed glycerides of the fatty acids. In the formulae, $R_2$ represents a straight-chain alkanoyl radical containing at least 12 and at most 14 carbon atoms. Example of such esters are glyceryl monolaurate, glyceryl dilaurate, glyceryl monomyristate, or glyceryl dimyristate, which are also known as monolaurin, dilaurin, monomyristin and dimyristin, respectively.

All esters that are used in the processes of the present invention are either esters of a tribasic acid or a metal salt thereof with a monohydric alcohol, or esters of a monobasic acid and a trihydric alcohol.

DETAILED DESCRIPTION AND PREFERRED EMBODIMENTS OF THE INVENTION

The invention is further described in connection with the Examples which follow, which Examples were selected solely for purposes of illustration and accordingly are to be understood not to be restrictive of the invention or its scope.

Unless otherwise specified, all parts herein refer to parts by weight and, since each composition contains 100 parts, the specified number of parts actually are equivalent to percentages by weight of the total composition.

EXAMPLE 1

Preparation of Compositions Containing Finishing Agents and Comparison of their Effectiveness as Emulsifiers.

The following compositions were prepared:

Composition A: This composition was prepared from the following ingredients:

| | |
|---|---|
| Phosphate Ester 1 | 40.0 parts |
| Isopropanol | 10.0 parts |
| Tetrachloroethylene | 50.0 parts |

Composition B: This composition was prepared from the following ingredients:

| | |
|---|---|
| Phosphate Ester 2 | 40.0 parts |
| Isopropanol | 10.0 parts |
| Tetrachloroethylene | 50.0 parts |

Composition C: This composition was prepared from the following ingredients:

| | |
|---|---|
| Glyceryl monolaurate (melting point 28° C | 40.0 parts |
| Isopropanol | 10.0 parts |
| Tetrachloroethylene | 50.0 parts |

Composition D: This composition was prepared from the following ingredients:

| | |
|---|---|
| Glyceryl dilaurate (melting point 31° C) | 40.0 parts |
| Isopropanol | 10.0 parts |
| Tetrachloroethylene | 50.0 parts |

Composition E: This composition was prepared from the following ingredients:

| | |
|---|---|
| Phosphate Ester 1 (as in Composition A) | 30.0 parts |
| Glyceryl monolaurate (as in Composition C) | 10.0 parts |
| Tetrachloroethylene | 50.0 parts |
| Isopropanol | 10.0 parts |

The five foregoing compositions were compared with the following three compositions which contained known commercially available synthetic resins that are used for the same purposes as the finishing agents to which this invention pertains.

Composition F: This composition was prepared from:

| | |
|---|---|
| Maleic resin | 40.0 parts |
| Tetrachloroethylene | 60.0 parts |

Composition G: This composition was prepared from the following ingredients:

| | |
|---|---|
| Polystyrene resin | 20.0 parts |
| Tetrachloroethylene | 80.0 parts |

Composition H: This composition was prepared from the following ingredients:

| | |
|---|---|
| Linseed-oil-modified alkyd resin | 20.0 parts |
| Paraffin wax consisting of normal paraffin hydrocarbons having from 20 to 24 carbon atoms | 10.0 parts |
| Condensation product of 5 mols of ethylene oxide and 1 mol of nonylphenol-polyglycol ether | 10.0 parts |
| Isopropanol | 10.0 parts |
| Tetrachloroethylene | 50.0 parts |

Comparative Tests of Emulsifying Effectiveness:

To determine the effectiveness of the finishing agents that are included in each of the foregoing compositions as emulsifying agents, each of the foregoing compositions was added in an amount equivalent to 5 grams per liter to a dry-cleaning composition. The latter composition consisted of a tetrachloroethylene solution of 5 grams per liter of a conventional dry-cleaning detergent on the base of an alkylated aromatic sulfonate and an ether of an alkyl phenol-polyglycol. Water was then gradually added to each of the test samples until the emulsion that was formed broke, that is, it was no longer stable. The maximum amount of water in grams per liter that could thus be added without producing an unstable emulsion was found to be as follows:

| | |
|---|---|
| Control (no finishing agent) | 14.75 grams per liter |
| Composition A: | 14.75 grams per liter |
| Composition B: | 14.00 grams per liter |
| Composition C: | 12.9 grams per liter |
| Composition D: | 9.2 grams per liter |
| Composition E: | 14.50 grams per liter |
| Composition F: | 5.90 grams per liter |
| Composition G: | 4.80 grams per liter |
| Composition H: | 2.50 grams per liter |

As stated in each case 5 g/l was used of the conventional detergent plus (except in case of the control) 5 g/l of the indicated compositions A–H.

Compositions A to E had substantially no effect on the characteristics of the resulting emulsion since the maximum amounts of water that were determined in these tests was nearly as great as the amount that was added to the control sample which contained no finishing agent. However, each of compositions F, G and H containing conventional synthetic resin finishing agent had significantly poorer emulsifying properties than the control, thereby demonstrating that they would have a deleterious effect when present in such a dry-cleaning composition. Even Composition D which had a lower value than any of the preferred finishing agents had a higher value than either of Compositions F, G or H.

EXAMPLE 2

Comparison of Wrinkle Recovery Properties

The wrinkle recovery characteristics of the foregoing compositions F, G, H, as well as the following composition I were compared with the finishing agents of the invention.

Composition I: This composition was prepared from the following ingredients:

| | |
|---|---|
| Phosphate Ester 2 (as in Composition B) | 30.0 parts |
| Glyceryl dilaurate (as in Composition D) | 10.0 parts |
| Isopropanol | 10.0 parts |
| Tetrachloroethylene | 50.0 parts |

For the test textiles of substantially equal weave were used as follows (weight per $m^2$)

| | |
|---|---|
| Wool | 416 g |
| Cotton | 470 g |
| 2½ acetate | 469 g |
| Polyamide 6 | 443 g |
| Polyester | 433 g |
| Polyacrylonitrile | 447 g |

The treating compound was applied by pressure application (padding) of a tetrachloroethylene solution of 10 g/l of the finishing agent followed by squeezing out the excess (squeeze effect: 150%).

The deposit of finishing agent was 0.4–0.5% by weight in case of compounds A–F, H and I and was 0.2–0.3% in case of compound G.

The wrinkle angle recovery was determined by DIN (German Norms) 53890 where the recovery angle is designated αO.

The test results were as follows (mean values):

| | un-treated | Compound | | | | | | | | |
|---|---|---|---|---|---|---|---|---|---|---|
| | | A | B | C | D | E | F | G | H | I |
| Wool | 85 | 108 | 92 | 124 | 105 | 129 | 97 | 132 | 116 | 116 |
| Cotton | 24 | 62 | 48 | 54 | 51 | 68 | 39 | 69 | 52 | 57 |
| 2½ acetate | 74 | 99 | 91 | 104 | 74 | 105 | 84 | 116 | 99 | 96 |
| Polyamide 6 | 74 | 80 | 74 | 69 | 44 | 82 | 68 | 94 | 76 | 78 |
| Polyester | 72 | 91 | 77 | 98 | 118 | 108 | 73 | 112 | 81 | 85 |
| Polyacrylonitrile | 89 | 91 | 91 | 93 | 69 | 93 | 84 | 101 | 89 | 90 |

The above figures show that the sizing and finishing effect of the compounds of the inventive process is the same as that of conventional synthetic resin finishing agents which, however, have the shortcomings above-described.

The finishing effect here referred-to is mainly the property of the agent to facilitate the smoothing of the textile when pressing or steaming it.

EXAMPLE 3

Comparison of Finishing Characteristics

In this Example, two compositions (A and K) were compared. Composition A and its preparation was described in Example 1 hereinbefore.

Composition K consisted of the following ingredients:

| | |
|---|---|
| Poly(oxyethylene)stearyl alcohol (same alcohol as part of composition A) | 40.0 parts |
| Isopropanol | 10.0 parts |
| Tetrachloroethylene | 50.0 parts |

In both cases the same fatty alcohol oxyethylate of similar waxy consistency and equal chain length and equal degree of oxyethylation was used having the formula $$CH_3(CH_2)_{17}\,O\,(CH_2\text{-}CH_2\text{—}O)_{10}\,H$$

and which had a similar minimum effect on the emulsion properties in case of equal concentration of effective agent in both cases. However, composition K was not a phosphoric acid ester.

The wrinkle recovery properties were determined as in Example 2 by the method of DIN 53890 with the following results:

| Untreated | Compound A | | Compound K |
|---|---|---|---|
| Wool | 85 | 108 | 72 |
| Cotton | 24 | 62 | 21 |
| 2½ acetate | 74 | 99 | 70 |
| Polyamide 6 | 74 | 80 | 74 |
| Polyester | 72 | 91 | 71 |
| Polyacrylonitrile | 89 | 91 | 85 |

Composition A containing Phosphate Ester 1 improved the wrinkle recovery distinctly whereas Composition K in comparison was even poorer than the control which was not subjected to any additional finishing treatment.

The treated fabrics were submitted to five different experts for evaluation of their hand, fullness, and stiffness, who reported unanimously that fabrics to which Compositions A and K had been applied were fuller and stiffer than the untreated control samples. No characteristic differences in this respect could be detected as between the two fabrics treated with Compositions A and K.

This example shows that fatty alcohol oxyethylates of waxy consistency, as present in both Compositions A and K, improve the hand and fullness of the fabrics but that the wrinkle recovery was improved only when the fatty alcohol oxyethylate had been esterified with phosphoric acid as in Composition A.

EXAMPLE 4

Practical Dry-Cleaning Tests

In this Example two compositions (L and M) were added to an actual dry-cleaning combination containing surfactants:

Composition L: This composition consisted of the following ingredients:

| | |
|---|---|
| Phosphate Ester 1 | 10.0 parts |
| Glyceryl monolaurate | 10.0 parts |
| Potassium dodecylbenzenesulfonate | 25.0 parts |
| Condensation product of 3 mols of ethylene oxide and 1 mol of nonylphenol-poly glycol ether | 7.0 parts |
| Condensation product of 9 mols of ethylene oxide and 1 mol of nonylphenol-poly glycol ether | 3.0 parts |
| Butylglycol | 3.0 parts |
| Water | 7.0 parts |
| Tetrachloroethylene | 35.0 parts |

Composition L, which is formed in accordance with the process of the present invention, was employed as detergent having effects also as a finishing agent in a conventional dry-cleaning machine in a concentration of 5 g/l for cleaning outer garments.

Composition M: This composition consisted of the following ingredients in the specified proportions:

| | |
|---|---|
| Composition H (as hereinbefore) | 50.0 parts |
| Conventional detergent consisting of mixture of alkyl aryl sulfonates and nonylphenol-polyglycol ethers | 50.0 parts |

Composition M was used under otherwise identical conditions in an amount of 10 g/l in order to have equal effective amounts both of the detergent-active agents and the finishing-active agents.

In a further test the conventional detergent was also used by itself in amounts of 5 g/l as a control.

The tests were carried out as follows:

1. Preliminary cleaning for a period of 3 minutes in a dry-cleaning bath in a machine with the pump operating at a low dip.
2. Spin-dry for 1 minute.
3. Cleaning for a period of 8 minutes in the machine with a filter and the pump operating at a high dip.
4. Spin-dry for 2 minutes.
5. Air-dry at 60° C.

In each of these tests, five test samples of garments consisting of men's suits and women's dresses, each having the same weight and each being soiled to the same extent with the same dirt or soil, were cleaned and to the dry-cleaning bath 2% by weight of water based on the weight of the soiled garment sample was added in each case.

To determine the degree of graying, swatches of white, bleached, unfinished webs of wool, cotton, 2½ acetate rayon, polyamide 6 (nylon), polyester, and polyacrylonitrile, which were free of any optical brightening agents, were subjected together with the soiled garments to the same cleaning treatment and the degree of graying of the swatches was determined by optical reflection measurements and calculated as percentage graying by dividing the difference between the initial reflection measurement and the reflection measurement after cleaning by the initial reflection measurement and multiplying the quotient by 100 as appears from the following formula:

$$\%\ \text{graying} = 100 \cdot \frac{Wo - Wv}{Wo}$$

$Wo$ = initial value (retention)
$Wv$ = Reflection after treatment

The surface loss was determined by means of a standard woolen cloth that was obtained from the International Wool Secretariate (IWS). This was subjected together with the soiled garments to the same cleaning treatment and the percentage surface loss was then determined.

The "percentage of spotting" was determined by counting the number of spotted portions that still remained after the cleaning in proportion to the number of garments cleaned in the corresponding test series.

The "finishing effect" relates to the effect of the specific finishing agent on the amount of finish employed. It is determined as the portion of the goods in condition for shipment after the simple finishing process (in a steam apparatus) relative to the number of garments (trousers excepted) cleaned in the respective test series.

The results were as follows:

| | Control | Composition L | Composition M |
|---|---|---|---|
| % Graying | | | |
| Wool | 0.5 | 0.8 | 2.1 |
| Cotton | 1.6 | 1.5 | 4.8 |
| 2½ Acetate rayon | 2.6 | 2.6 | 2.7 |
| Polyamide 6 | 3.0 | 3.2 | 4.1 |
| Polyester | 3.2 | 3.5 | 5.8 |
| Polyacrylonitrile | 2.7 | 2.6 | 3.4 |
| Surface loss | | | |
| Warp | 3.7 | 3.7 | 7.0 |
| Weft | 1.8 | 1.8 | 3.7 |
| % Spotting | 22 | 18 | 26 |
| % Finishing effect | 60 | 85 | 75 |

In a parallel series of laboratory tests the wrinkle angle recovery was determined as in DIN 53890 (see Ex. 2) in testiles treated with 5 g/l of conventional detergent, 5 g/l of compound L and 10 g/l of compound M.

The conventional detergent was as specified above in Example H.

The following mean values were obtained:

| | Untreated | conventional detergent | Compound L | Compound M |
|---|---|---|---|---|
| Wool | 85 | 78 | 110 | 93 |
| Cotton | 24 | 29 | 55 | 45 |
| 2½ acetate | 74 | 62 | 91 | 89 |
| Polyamide 6 | 74 | 69 | 82 | 76 |
| Polyester | 72 | 72 | 105 | 79 |
| Polyacrylonitrile | 89 | 81 | 88 | 89 |

The process of finishing textiles with the finishing agents that are used in the processes of the present invention can be carried out in the same manner as in other conventional finishing processes.

The subsequent finishing of textiles with the finishing agents that are used in the processes of the present invention can be performed in the dry-cleaning bath, in which case the finishing agent is added directly to the dry-cleaning bath or together with a portion of the solvent or the detergent.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A process for the treatment of a textile fabric for improving its hand, fullness, flexibility, wrinkle recovery, and ease of cleaning which process comprises applying to the surface of the fabric a solution of a finishing agent selected from the group consisting of phosphoric acid esters of poly(oxyethylene) alkanols having the formula:

$$[R{-}O{-}(CH_2CH_2O)_n]_3P{=}O$$

and mixtures of these esters with salts having the formula

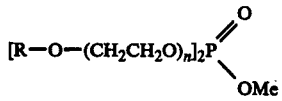

in which formulae R is a straight-chain alkyl radical having at least 16 and at most 18 carbon atoms, $n$ is an integer of at least 10 and atmost 14 and Me is a monovalent metal ion.

2. The process of claim 1 wherein the solvent for the finishing agent is tetrachloroethylene.

3. The process of claim 1 wherein the salt of the phosphoric acid ester is a sodium or potassium salt.

4. The process of claim 1 wherein the finishing agent further includes a glyceryl laurate.

5. In a process for the dry cleaning of a textile fabric in a bath containing a detergent in an organic dry-cleaning solvent, the improvement which comprises adding to the bath at least one of the finishing agents defined in claim 1, the finishing agent acting as emulsifying agent in the dry-cleaning operation and the organic dry-cleaning solvent including water in an amount below that at which the emulsion formed becomes unstable.

6. A process as defined in claim 1 in which the finishing agent is a mixture of a phosphoric acid ester of a poly(oxyethylene) alkanol and a sodium salt thereof having the formula $$[CH_3(CH_2)_{17}{-}O{-}(CH_2CH_2O)_{10}]_3P{=}O$$

and

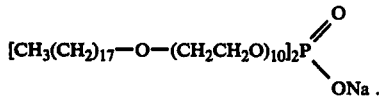

7. A process as defined in claim 1 in which the finishing agent is a mixture of phosphoric acid esters of poly(oxyethylene) alkanols and sodium salts thereof having the formulae $$[CH_3(CH_2)_{15}{-}O{-}(CH_2CH_2O)_{14}]_3P{=}O$$

$$[CH_3(CH_2)_{17}{-}O{-}(CH_2CH_2O)_{14}]_3P{=}O$$

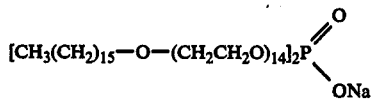

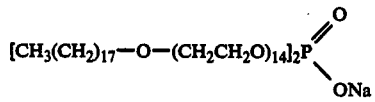

* * * * *